United States Patent [19]

Pusch et al.

[11] 4,057,107

[45] Nov. 8, 1977

[54] METHOD OF INITIATING UNDERGROUND IN-SITU COMBUSTION

[75] Inventors: Günter Pusch, Celle; Rudolf Gedenk, Ovelgonne, both of Germany

[73] Assignee: Deutsche Texaco Aktiengesellschaft, Hamburg, Germany

[21] Appl. No.: 737,936

[22] Filed: Nov. 2, 1976

Related U.S. Application Data

[60] Division of Ser. No. 595,266, July 11, 1975, Pat. No. 4,014,721, which is a continuation of Ser. No. 427,158, Dec. 21, 1973, abandoned.

[30] Foreign Application Priority Data

Dec. 29, 1972 Germany ..... 2263960

[51] Int. Cl.[2] ..... C06B 25/02; E21B 43/24

[52] U.S. Cl. ..... 166/260

[58] Field of Search ..... 166/260, 261, 262, 302, 166/256, 300; 44/66

[56] References Cited

U.S. PATENT DOCUMENTS

| | | | |
|---|---|---|---|
| 2,863,510 | 12/1958 | Tadema | 166/260 |
| 3,087,540 | 4/1963 | Parker | 166/260 |
| 3,127,935 | 4/1964 | Poettmann et al. | 166/260 |
| 3,180,412 | 4/1965 | Bednarski et al. | 166/260 |
| 3,314,476 | 4/1967 | Staples et al. | 166/260 |
| 3,360,041 | 12/1967 | Santourian | 166/260 |
| 3,379,254 | 4/1968 | Holmes | 166/260 |
| 3,400,763 | 9/1968 | Klein et al. | 166/260 |
| 3,449,247 | 6/1969 | Bauer | 166/302 X |
| 3,490,530 | 1/1970 | Dean et al. | 166/260 |
| 3,493,060 | 2/1970 | Van Dyk | 166/302 X |

*Primary Examiner*—Stephen J. Novosad

*Attorney, Agent, or Firm*—Thomas H. Whaley; Carl G. Ries; Charles L. Bauer

[57] ABSTRACT

A method for the initiation of an in-situ combustion in an underground formation by injecting into the formation an ignition mixture containing an olefinic hydrocarbon or an unsaturated fatty acid, an organic peroxide and a heavy metal salt.

11 Claims, No Drawings

METHOD OF INITIATING UNDERGROUND IN-SITU COMBUSTION

This is a division, of application Ser. No. 595,266, filed July 11, 1975, now U.S. Pat. No. 4,014,721, which is a continuation of application Ser. No. 427,158 filed Dec. 21, 1973, now abandoned.

FIELD OF THE INVENTION

This invention relates to a method for initiating an underground combustion by means of an ignition mixture containing an olefinic hydrocarbon or unsaturated fatty acid, an organic peroxide and a heavy metal salt.

DESCRIPTION OF THE PRIOR ART

Underground combustion processes are being used worldwide in an ever-increasing measure to produce raw materials and also to recover hydrocarbons from subterranean formations. In view of the growing shortage of raw materials and energy resources, these processes will in the future gain still greater importance in enhancing the exploitation of subterranean hydrocarbon-bearing formations.

The in-situ or underground combustion process is based on the principle of altering the physical properties of the reservoir or deposit material (e.g. the hydrocarbon contained therein) by the generation of heat, leading, for example, to a change of the raw material contained therein to improve its flow properties or render it flowable. These methods may be exemplified by underground gasification of coal using an in-situ combustion process, the recovery of sulfur using the Frasch process, or the recovery of petroleum by means of secondary recovery. The partial combustion of the raw material is initiated somewhere in the reservoir deposit and thereafter is sustained by an oxygen-containing gas.

In the matter of recovery of petroleum from subterranean hydrocarbon-bearing formations, one method of secondary recovery has employed in-situ or underground combustion. In the conventional method of applying this in-situ combustion method, the hydrocarbon-bearing formation is penetrated by an injection well and one or more of said production wells. An oxygen-containing gas such as air is injected via the injection well and the combustion of the hydrocarbons is initiated in the formation.

In the initiation of the in-situ combustion, heat is generated that serves to heat the oxygen-containing gas and heat carrier respectively to the temperature required to ignite the raw material. The initiation of the in-situ combustion may be accomplished by one of many accepted means, such as downhole gas-fired heaters or electrical heaters or chemical means, using a strongly exothermic chemical reaction. Initiation may also be accomplished by igniting an igniting agent electrically or chemically in the wellbore after which the combustion is transferred to the combustible raw material in the reservoir by an oxygen-containing gas via an easily ignitible substance. Ignition processes may also use highly concentrated hydrogen peroxide where use is made of the heat of decomposition of the hydrogen peroxide to ignite the raw material in the deposit. Such a process has been described in German application No. P 20, 18, 372.6. In a comparison between the energy content of organic fuels used as ignition promoters and that of hydrogen peroxide based on one kilogram of the substance, the organic fuels yield far better values. Organic fuels provide heat of combustion of from 6,000 to 10,000 kcal/kg where the energy set free by the decomposition of hydrogen peroxide is only 692 kcal/kg.

The second group of chemical ignition processes includes, for example, the spontaneous ignition process using linseed oil and dimethylaniline. Linseed oil is a readily oxidizable substance and the dimethylaniline serves as a catalyst to accelerate the reaction. This reaction is an an autooxidation reaction in which peroxides have to be formed.

In its initial phase the reaction proceeds at a very reduced rate via several intermediate stages, which is due to energy reasons. Thus, it is known, for example, from "Modern Pyrotechnics" by H. Ellern, Chemical Publishing Co., New York, 1961, pages 36–37, that unsaturated organic substances such as linseed oil are subject to a combustion or spontaneous ignition with air. The spontaneous ignition is substantially dependent on the degree of saturation of the organic compound and on the presence of catalysts. In practice, however, these ignition processes have a relatively long ignition duration.

Accordingly, it is an object of the present invention to provide an ignition mixture suitable for initiating underground combustion.

It is another object of the present invention to improve the known autooxidation-ignition processes by reducing the duration of the ignition phase. It is yet another object of the invention to reduce the duration of the ignition phase by adding specific oxidation initiators.

SUMMARY OF THE INVENTION

This invention relates to a method for initiating underground combustion by use of an ignition mixture containing olefinic hydrocarbons or unsaturated fatty acids, organic peroxides and heavy metal salts.

DESCRIPTION OF THE METHOD

A broad aspect of the invention comprises introducing via an injection well into a formation an ignition mixture that substantially is composed of three ingredients or components having the specific functions of:

1. An initial igniting agent.
2. An initiator.
3. An activator.

The initial igniting agent is required to supply energy to the underground deposit thereby effecting changes in the properties of the raw materials or combustible materials present in the deposit. Unsaturated hydrocarbons are suitable initial igniting agents. Preferred members of this group of unsaturated hydrocarbons include olefinic hydrocarbons such as ethylene, propylene, butylene, butadiene. Other suitable initial igniting agents include the compounds selected from the group consisting of unsaturated fatty acids, linseed oil, linseed oil fatty acids and oleic acid being preferred according to the invention. Mixtures of these fatty acids are also useful initial igniting agents.

According to the invention the use of an initiator to start the oxidation of the initial igniting agent is contemplated. Presumably, the initiator serves to accelerate the autooxidation process. The organic peroxides are advantageously used as radical-forming agents or initiators respectively. "Organic peroxides" are defined as compounds derived from hydrogen peroxide and containing organic groups such as hydroperoxides, dialkyl peroxides, diacly peroxides, peroxy acids, peroxy esters, peroxy ketals and ketone peroxides. It has been shown that effective initiators in the ignition mixture of the invention consist of peroxides with a heat of decomposition of more than 2.6 kcal/mole. These peroxides include, in particular, tertiary butylperbenzoate, tertiary butylhydroperoxide and methylisobutylketone peroxide.

The activator serves to cause the initiator to decompose into radicals at a certain low temperature, thereby accelerating the oxidation of the initial igniting agent. The term "activator" is understood to include all chemical compounds effecting a controlled decomposition of the initiator under the process conditions. The use of heavy metal salts as activators, optionally dissolved or suspended in a solvent, has proved to be particularly effective. Preferably, heavy metal salts are, for example, vanadium oxychloride dissolved or suspended in isopropyl alcohol or cobalt octoate in styrene or cinnamene.

The composition of the ignition mixture that may be used to accomplish the desired ignition consists of:

a. up to 30 parts by weight of the initial igniting agent such as an olefinic hydrocarbon or an unsaturated fatty acid, b. from 0.01 to 15 parts by weight of an initiator such as an organic peroxide, c. from 0.001 to 0.1 parts by weight of an activator such as a heavy metal salt, which salt may be dissolved or suspended in a solvent.

Preferably the ignition mixture consists of from 2 to 15 parts by weight of the initial igniting agent, from about 0.5 to 1 part by weight of the initiator and about 0.025 to 0.075 parts by weight of the activator.

In accomplishing the ignition, the ignition mixture is introduced into the deposit in an amount of from 0.1 to 7 $m^3$ per meter of reservoir thickness. The amount and composition of the ignition mixture are dependent on the conditions of the deposit or reservoir such as thickness, fuel concentration in the vicinity of the injection well and reservoir temperature as well as on the composition of the ignition gas.

In one embodiment of the invention an underground reservoir or deposit is provided with an injection well that traverses the reservoir and which well contains separate tubing string means. The ignition mixture is injected into the deposit via one suitable tubing string means by displacement with an inert gas, as, for example, nitrogen or carbon dioxide. Through a second tubing string means an oxygen-containing gas is injected to ignite the ignition mixture. The injected oxygen-containing gas may contain from 10 to 100 volume percent of pure oxygen. Air is a preferably oxygen-containing gas. Excess igniting agent is removed from the well or it is displaced completely into the formation and the injection of the oxygen-containing gas in continued until the initial igniting agent is ignited. By further injection of the oxygen and heat carrier respectively, the combustion is transferred to the original combustible material or fuel present in the reservoir or deposit.

The following examples further illustrate the novel ignition mixture:

EXAMPLE 1

A porous rock core was saturated to 50% with an ignition mixture consisting of 10.5 parts by weight of linseed oil, 1 part by weight of tert. butylperbenzoate and 0.05 part by weight of vanadium oxychloride dissolved in isopropyl alcohol (25% solution). After heating the core to 55° C., an ignition gas consisting of 60% of oxygen and 40% of nitrogen was injected at a rate of 0.5 standard liters per minute and under a pressure of 20.6 bar.

After an injection period of 69 minutes, the temperature in the core had risen to about 270° C., that is to say, the fuel was ignited. Analyses of the waste gas and the coked residue gave evidence of a combustion having taken place. The same experiment without the addition of peroxide failed to bring about an ignition.

EXAMPLE 2

A porous core of Bentheim sandstone, 51 mm wide and 91 mm long, was saturated to 50% with an ignition mixture consisting of 78 parts by weight of linseed oil fatty acid, 21 parts by weight of tert.-butylperbenzoate and 1 part by weight of vanadium-oxychloride dissolved in isopropyl alcohol (25% solution). The core was heated to 55° C. and an ignition gas comprising 60% of oxygen and 40% of nitrogen was injected under a pressure of 20.6 bar. After an injection time of 17 minutes the mixture was ignited. The rise in temperature was similar to that of Example 1.

EXAMPLE 3

Two equally thick sand packings of a medium-grain sand (average grain diameter 0.25 mm) were tamped each into one of the two chambers of a modified differential thermo-analysis cell. The two chambers were separated from each other by a ceramic plate of approximately 6 mm thickness. Each chamber contained a thermocouple. One of the two chambers was filled with an oil (API gravity 28°) up to 75% of the pore volume of the sand packing. The other chamber was filled to the same extent with a mixture consisting of 49.74 volume percent of oil (API gravity 28°), 49.75 volume percent of tert.-butylhydroperoxide and 0.5 volume percent of cobalt octoate containing 10% of cobalt. The cell was heated at a rate of about 0.8° C. per minute and at the same time flushed with oxygen at a rate of 1.94 $cm^3$ per minute at a pressure of 16 bar. At first, the temperature measured was the same in both chambers. At 60° C. carbon dioxide and at 110° C. carbon monoxide were first determined in the off-gas. At about 130° C. the temperature in the chamber containing the ignition mixture rose by 17.6° C. above the temperature of the comparative sample. Complete combustion of the organic matter was not observed, because the dissipation of heat of the cell was too great.

Thus is described a method for the initiation of an underground deposit or formation by utilizing an ignition mixture containing an initial igniting agent, an initiator and an activator. Other modifications will be apparent from the foregoing description without departing from the scope of the invention as defined in the following claims.

We claim:

1. A method for initiating in-situ combustion in an underground formation containing a combustible material said formation being penetrated by an injection well which comprises the steps of:

a. introducing into said formation via said injection well an ignition mixture containing from about 2 to about 30 parts by weight of the total weight of said mixture of olefinic hydrocarbons or unsaturated fatty acids, from about 0.1 to 15 parts by weight of an organic peroxide and from about 0.001 to 0.1 parts by weight of a heavy metal salt, b. injecting into said formation via said injection well an oxygen-containing gas, c. continuing said injection of said oxygen-containing gas to ignite said combustible material in said formation.

2. The method of claim 1 wherein said olefinic hydrocarbons are selected from the group consisting of ethylene, propylene, butylene, butadiene and mixtures thereof.

3. The method of claim 1 wherein said unsaturated fatty acids are selected from the group consisting of linseed oil, linseed oil fatty acids, oleic acids and mixtures thereof.

4. The method of claim 1 wherein said organic peroxide is selected from the group consisting of tertiary butylperbenzoate, tertiary butylhydroperoxide, methyl isobutylketone peroxide, and mixtures thereof.

5. The method of claim 1 wherein said heavy metal salt is a heavy salt selected from the group consisting of vanadium oxychloride, cobalt octoate and mixtures thereof.

6. The method of claim 5 wherein said heavy metal salt is contained in a solvent.

7. The method of claim 6 wherein said solvent is isopropyl alcohol.

8. The method of claim 6 wherein said solvent is styrene.

9. The method of claim 1 wherein said oxygen-containing gas comprises a gas containing from about 10% to about 100% by volume of pure oxygen.

10. The method of claim 9 wherein said oxygen-containing gas is air.

11. The method of claim 1 wherein said ignition mixture is injected into said deposit having said injection well via a first tubing string means and said oxygen-containing gas is injected via a second tubing string means.

* * * * *